US006497773B1

(12) United States Patent
Shih

(10) Patent No.: US 6,497,773 B1
(45) Date of Patent: Dec. 24, 2002

(54) METHOD OF MANUFACTURING A MASK FOR TEAM GAMES

(75) Inventor: Jung-Tso Shih, San Chung (TW)

(73) Assignee: Yu Hsun Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 09/920,934

(22) Filed: Aug. 3, 2001

(51) Int. Cl.[7] ..... B23K 28/02; A63B 71/10

(52) U.S. Cl. ..... 148/517; 148/518; 148/528; 2/425

(58) Field of Search ..... 148/517, 518, 148/528, 535; 2/425

(56) References Cited

U.S. PATENT DOCUMENTS 4,699,674 A * 10/1987 Finnegan ..... 148/528
6,128,786 A * 10/2000 Maddux et al. ..... 2/425
6,235,409 B1 * 5/2001 Serafin et al. ..... 1448/535

* cited by examiner

*Primary Examiner*—George Wyszomierski
(74) *Attorney, Agent, or Firm*—Bacon and Thomas

(57) ABSTRACT

A method of manufacturing a mask for a team game is comprised of: heating an aluminum alloy mixed with copper and molybdenum at a temperature between 410° C. to 430° C. for three hours; cooling the alloy at a rate of about 30° C. per hour; cutting the alloy into straight or curved bars; heating the bars at a temperature between 450° C. to 550° C. for one and one half hours; quenching the bars in water after seven seconds have passed; heating the bars at a temperature between 100° C. to 150° C. for 18 hours; cooling in air; forming an unfinished mask by resistance brazing; and treating the unfinished mask to produce the finished mask by anodizing.

3 Claims, 1 Drawing Sheet

METHOD OF MANUFACTURING A MASK FOR TEAM GAMES

FIELD OF THE INVENTION

The present invention relates to masks and more particularly for an improved method of manufacturing masks for team games such as baseball.

BACKGROUND OF THE INVENTION

A conventional process of manufacturing a mask for team games such as baseball is comprised of: cutting the material, (e.g., steel), into a plurality of straight or curved bars of predetermined length; welding the bars to form a wire screen (i.e., unfinished mask); plunging the unfinished mask into a plastic powder for coating; and curing the unfinished mask to produce a finished mask with a layer of plastic coated thereon.

But this is unsatisfactory for the purpose for which the mask is concerned for the following reasons: The weight of a mask manufactured as described above is relatively heavy due to the steel material. A player wearing such a heavy mask may feel uncomfortable. Moreover, the mask tends to rust. The welding step is time consuming. Furthermore, the quality is unsatisfactory: both surface strength and shock absorbability of the mask are low because no special processing on the material is done.

Thus, it is desirable to provide an improved method of manufacturing a mask for team games in order to overcome the above drawbacks.

SUMMARY OF THE INVENTION

It is therefore an object of the present invention to provide a method of manufacturing a mask for team games comprised of the following steps: heating an aluminum alloy mixed with copper and molybdenum at a temperature of about 410° C. to about 430° C. for three hours; cooling the alloy at a rate of about 30° C. per hour. The alloy is then cut into a plurality of straight or curved bars of predetermined length.

The mask then produced by a 2 step treatment. T4 treatment: Heating the bars at a temperature between 450° C. to 550° C. for about one and one half hours; quenching the bars in water at 30° C. after seven seconds have passed.

T6 treatment: Heating the bars at a temperature between 100° C. to 150° C. for 18 hours; cooling in air; forming an unfinished mask by resistance brazing; and treating the unfinished mask to produce the finished mask by anodized or plastic powder coating.

The above and other objects, features and advantages of the present invention will become apparent from the following detailed description taken with the accompanying drawings.

DETAILED DESCRIPTION OF THE PREFERRED EMBODIMENTS

Figure 1:
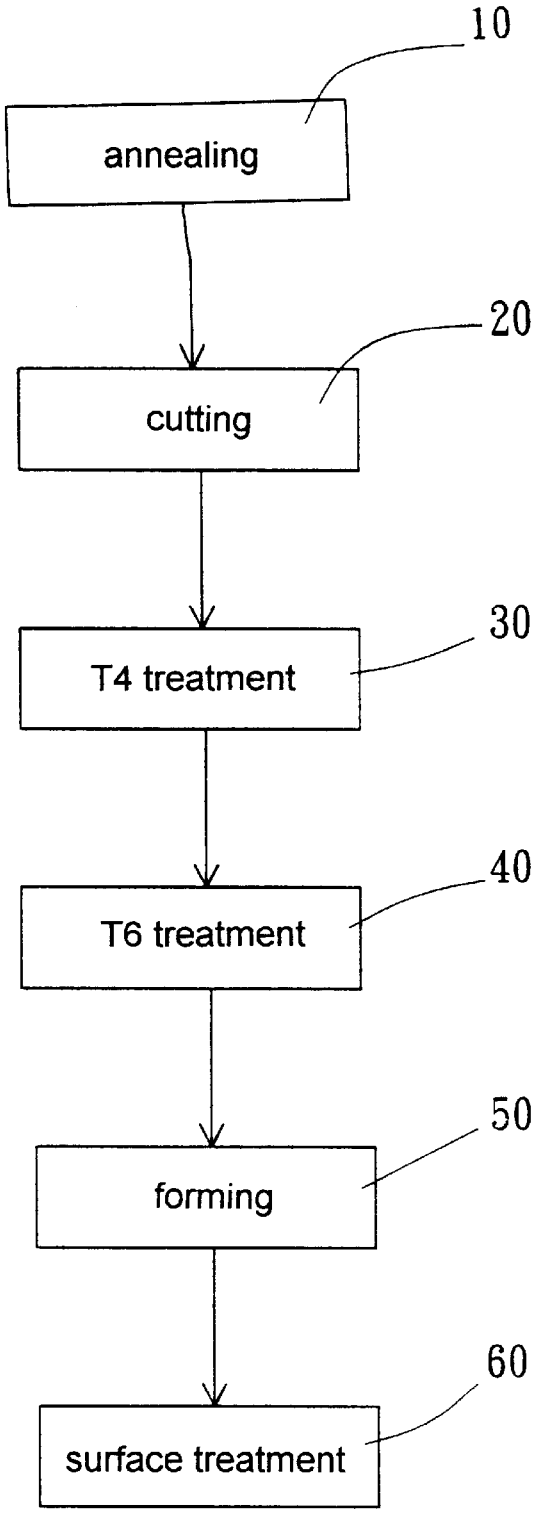
FIG. 1 is a flow chart illustrating a process of manufacturing mask for team games according to the invention.

FIG. 1 shows a process of manufacturing a mask for team games such as baseball according to the invention. The process comprises the following steps:

Step 10 (annealing): Heat the material (e.g., alloy, a mixture of aluminum (major component), copper, molybdenum, etc.) at a temperature between 410° C. to 430° C. for three hours and then cool slowly at a rate of about 30° C. per hour.

Step 20 (cutting): Cut the aluminum alloy into a plurality of straight or curved bars of predetermined length.

Step 30 (T4 treatment): Heat the bars at a temperature between 450° C. to 550° C. for one and one half hours. Then quench the bars in water at a temperature of no more than 30° C. after seven seconds have passed.

Step 40 (T6 treatment): Heat the bars at a temperature between 100° C. to 150° C. for 18 hours. Then cool at an air temperature of about 3° C. to −3° C.

Step 50 (forming): Form a wire screen (i.e., an unfinished mask) by resistance brazing.

Step 60 (surface treatment): Treat the unfinished mask to produce a finished mask by anodizing. Alternatively, either dye the unfinished mask or plunge it into a plastic powder coating.

The advantages of the invention are as follows: The weight of a mask produced by this method is about one third of a mask formed of conventional steel material. Since the mask has gone through the annealing and quenching processes, a test result shows that the mask has a tensile strength of 70,000 psi, a hardness of 120 BHN, a percent elongation of 14% to 21%, and a transverse rupture strength of 60,000 psi. This is a significant improvement over prior methods with respect to material quality. In addition, the new method for alloy resistance brazing is safer, quicker, and allows a higher precision weld than the conventional process in steel material. Moreover, the structural strength is enhanced significantly.

While the invention has been described by means of specific embodiments, numerous modifications and variations could be made thereto by those skilled in the process without departing from the scope and spirit of the invention set forth in the claims.

What is claimed:

1. A method of manufacturing a mask for a team game comprised of the following steps:

(a) Heating an aluminum alloy containing copper and molybdenum at a temperature between 410° C. to 430° C. for three hours;

(b) Cooling the alloy at a rate of about 30° C. per hour;

(c) Cutting the alloy into a plurality of straight or curved bars;

(d) Heating the bars at a temperature between 450° C. to 550° C. for one and one half hours;

(e) Quenching the bars in water after seven seconds have passed;

(f) Heating the bars at temperature between 100° C. to 150° C. for 18 hours;

(g) Cooling in air;

(h) Forming an unfinished mask by resistance brazing; and (i) Treating the unfinished mask to produce a finished mask by anodizing.

2. The method of claim 1, wherein the water temperature in step (e) is no more than 30° C.

3. The method of claim 1, wherein the air temperature in step (g) is about 3° C. to −3° C.

* * * * *